US005152413A

United States Patent [19]

Conrad

[11] Patent Number: 5,152,413

[45] Date of Patent: Oct. 6, 1992

[54] BRIDGE DESIGN FOR TAMPER EVIDENT CLOSURES

[75] Inventor: William A. Conrad, Harleysville, Pa.

[73] Assignee: The West Company, Incorporated, Phoenixville, Pa.

[21] Appl. No.: 557,798

[22] Filed: Jul. 26, 1990

[51] Int. Cl.[5] ..... B65D 51/18

[52] U.S. Cl. ..... 215/249; 215/251; 215/258

[58] Field of Search ..... 215/249, 250, 251, 258, 215/DIG. 3

[56] References Cited

U.S. PATENT DOCUMENTS

| | | | |
|---|---|---|---|
| 3,071,274 | 1/1963 | Raun | 215/249 |
| 3,358,865 | 12/1967 | Andersen | 215/249 |
| 3,587,897 | 6/1971 | Rohde | 215/249 |
| 4,471,879 | 9/1984 | Connor et al. | 215/249 |
| 4,709,823 | 12/1987 | Beck et al. | 215/235 |

FOREIGN PATENT DOCUMENTS

| | | | |
|---|---|---|---|
| 2238645 | 2/1975 | France | 215/249 |

*Primary Examiner*—Stephen Marcus
*Assistant Examiner*—Stephen Cronin
*Attorney, Agent, or Firm*—Eugene Renz, Jr.

[57] ABSTRACT

A device for forming a closure, including first and second dies for cooperatively forming the closure. The dies come into mutual contact against both sides of an annular disc. The dies form a center hole and cooperatively operate to form a shoulder and skirt on the outer part of the closure. The annular center section and bridges are formed by action of a plurality of die stems which form a recessed dependent lip on the shoulder and which form frangible bridges connecting the lip to the central section.

5 Claims, 3 Drawing Sheets

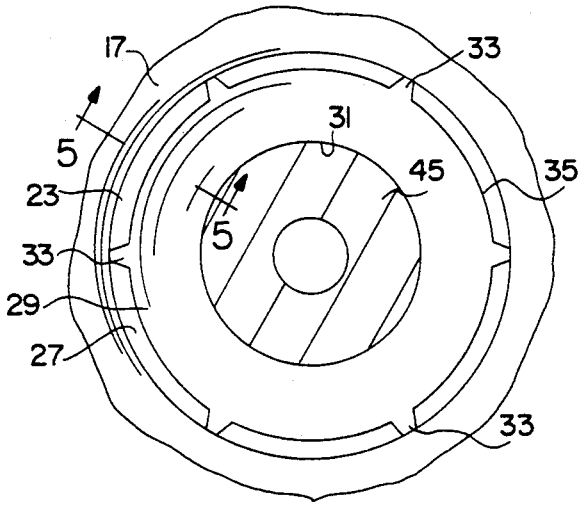
FIG. 2
FIG. 1
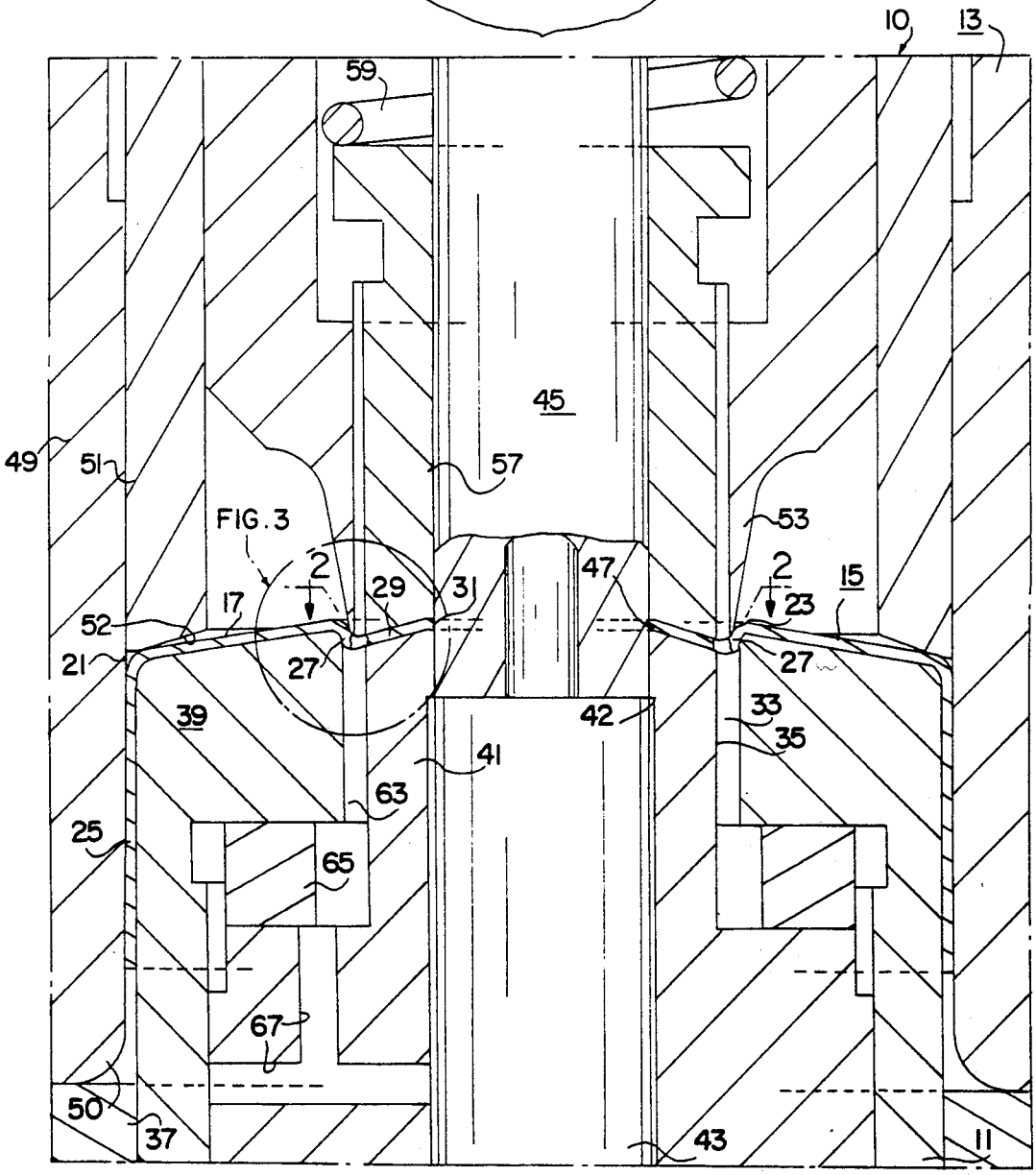

BRIDGE DESIGN FOR TAMPER EVIDENT CLOSURES

FIELD OF THE INVENTION

The present invention relates to a closure with an improved bridge design. More particularly, the invention relates to dies which are used to form an improved cap in which frangible bridges and an annular center section are recessed by locating the bridge at the bottom of the turned down edge of the tab holding the bridges.

BACKGROUND OF THE INVENTION

Pharmaceutical containers for liquids have a piercable closure member such as a disc or stopper which is formed of rubber or other elastomeric materials, held in place with a metal cap. Such caps generally have an inner removable disc which is detachably secured to the outer annular top portion by fractional or frangible bridges. By lifting off the center disc portion which is attached to an outer cap, a portion of the stopper is made available for piercing with syringes or intravenous spikes.

One system for employing such caps with a cover which is attached to the outer annular portion of the cap and which may be removed by the thumb is shown in U.S. Pat. No. 3,071,274. Still another alternative technique is the use of a tear-off cap which provides a hinged central portion at the top of the cap to provide a grip for tearing off the cover over the stopper and around the top of the container. A hypodermic syringe and needle is employed often to add or remove fluids to the container and it is desirable to be able to expose the rubber stopper portion of the closure by simply removing the overcap.

Even though a number of systems have been designed which employ a thumb removable overcap, none of them have been found to be absolutely ideal under certain circumstances of use. Specifically, even though the rubber stopper may be sterilized during manufacture, and even though the overcap may keep the portion of the stopper which is to be penetrated by the syringe needle free from contamination, there is always the concern that once the overcap has been removed, the exposed rubber stopper may be contaminated prior to use. For example, in the very process of removing the cap with the thumb, the thumb itself could come in contact with the exposed surface of the rubber stopper. This is not a problem if the user is wearing sterilized gloves, although even in that case the gloves may become contaminated merely by picking up the bottle. Accordingly, it is conventional in laboratories and doctors' offices, for example, to swab the surface of the exposed rubber stopper prior to the penetration of the stopper with a sterilized needle.

Often times, when the overcap is removed and the frangible bridges are fractured, small portions of metal remain exposed. At the very least, the swabbing material becomes snagged. If this is unexpected, there is the danger of dropping the vial. At worst, the sterilized gloves or even the hand of the user can be cut on these small sharp pieces.

Accordingly, it is a principle object of the present invention to obviate the possibility of exposed portions of the frangible bridges interfering with the essential step of swabbing the top of the exposed rubber stopper. Other objects will appear hereinafter.

SUMMARY OF THE INVENTION

The present invention relates to a closure for use with containers in which a cap portion is defined, having an outer dependent skirt for attachment to a container. A recessed lip is formed on the inner terminal edge of the shoulder portion contacting the top of the stopper. The lip extends in a generally downward direction. An annular center section is attached to the recessed lip by a plurality of spaced apart, recessed bridges. The bridges are preferably tapered, narrowing in a radially outward direction, so that when the inner annular section is removed, the bridges are also removed.

The invention also comprises a device for forming such a closure. First and second die means are provided for cooperatively forming the closure by coming into mutual contact against both sides of an annular disc. The dies form a center hole in the disc and cooperatively operate to form the shoulder and skirt on the outer part of the closure. The annular center section and bridges are formed by action of a plurality of stem means which form the recessed dependent lip on the shoulder and which form frangible bridges connecting the lip to the central section.

BRIEF DESCRIPTION OF THE DRAWINGS

These and other objects of the present invention and the various features and details of the operation and construction thereof are hereinafter more fully set forth with reference to the accompanying drawings, where:

FIG. 1 is an enlarged fragmentary sectional elevational view, showing first and second dies forming a recessed tapered bridge on a closure member, with the dies in the final stroked position and the cap in a fully formed condition.

FIG. 2 is a fragmentary sectional plan view, taken on the line 2—2 of FIG. 1 showing the upper plan of the closure member, just in the zone of the bridges, indicating the number of bridges and that the bridges are tapered.

DETAILED DESCRIPTION OF THE PREFERRED EMBODIMENT

Figure 3:
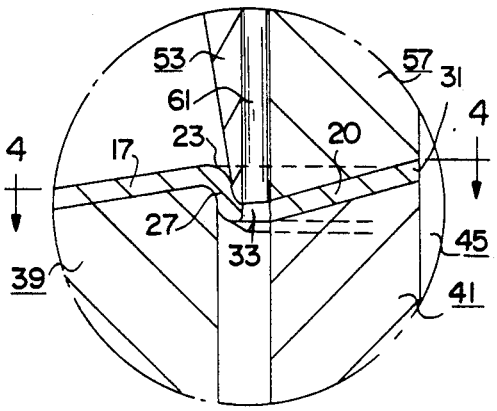
FIG. 3 is a greatly enlarged fragmentary view of the detail contained within the dot and dash circle of FIG. 1 and designated FIG. 3 showing cooperation of the dies to form the recessed tapered bridge.

While closures have existed for many years, the improved closures of the present invention make a major contribution by providing frangible bridges which are easily broken when it is desired to remove the overcap and which do not present sharp edges which would present any risk whatsoever to the user, for example, when swabbing the exposed rubber stopper the swabbing material will not snag because the sharp edges are gone.

To best understand the invention, it is desirable to view the die system, shown generally by the reference numeral 10. This die system includes a lower or first die means shown generally at 11 and an upper or second die means shown generally at 13. An annular disc, again shown generally by the reference numeral 15 is formed into the closure of the present invention by mating the two dies 11 and 13 as hereinafter described. Schematically, the invention comprises the action of a lower die 11 and an upper die 13 on disc 15. Each die 11 and 13 has multiple parts, as shown below, and will form a completed product from disc 15 which also has multiple parts. Numeral 11, 13 and 15 are references to the schematic parts of the lower die, upper die and disc respectively.

Figure 7:
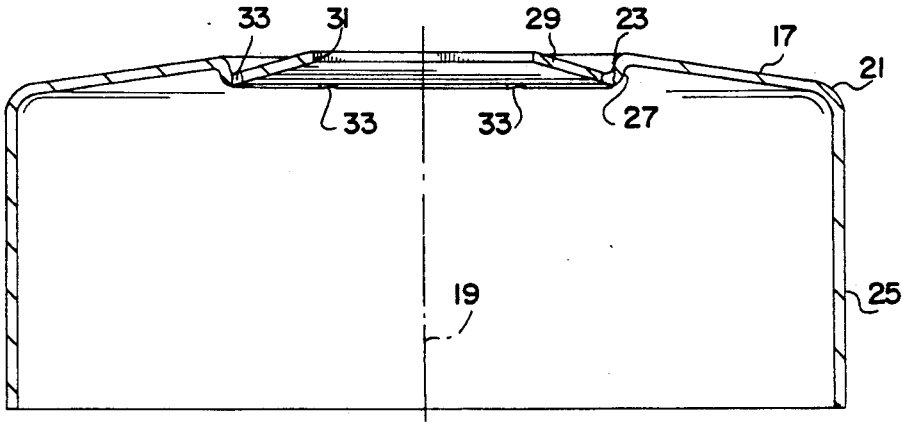
FIG. 7 is an enlarged sectional elevational view of a thin metallic closure formed according to the present invention.

FIG. 1 shows the upper and lower dies forming the recessed tapered bridges on the closure, and is shown in the final stroked position and the overcap is fully formed. The cap itself is also shown in FIG. 7. The cap includes an annular shoulder 17 which is centered about the axis 19. Shoulder 17 has a radial outer terminal edge 21 and a radial inner terminal edge 23. Dependent skirt 25 is located on the outer terminal edge 21 of shoulder 17 and extends in a downward direction generally parallel to axis 19. Recessed dependent lip 27 is formed on the inner radial terminal edge 23 and extends downwardly from shoulder 17 as shown.

The closure also includes an annular center section 29 extending from a point proximate the end of the recessed dependent lip 27 to a center hole which is formed to locate the inner edge 31 of the annular center section 29. The center section 29 is frangibly attached to recess dependent lip 27 by a plurality of bridges 33 which are spaced apart from each other, as shown in FIG. 2, for example. The bridges 33 are separated from one another by annular gap 35.

In a preferred embodiment, the bridges 33 are tapered so that the larger annular side of the bridge 33 is attached to the annular center section and the smaller part of the tapered bridge 33 is attached to recessed dependent lip 27. As will be apparent hereinafter, when bridges 33 are fractured, the path of least resistance is to have a fracture take place at the junction with recessed dependent lip 27. Since recessed dependent lip 27 is facing into the rubber stopper, fracture of the bridge at this point will cause the junction between recessed lip 27 and bridge 33 t be faced into the rubber stopper to eliminate any possibility of protruding sharp edges.

Turning now again to FIG. 1, the operation of the lower die 11 and the upper die 13 on the annular disc 15 is seen to produce the just described closure. The lower die 11 includes an outer table ring 37 which forms a support for the lower die. Also included is an annular center die ring 39 on which the shoulder 17, outer terminal edge 21 and dependent skirt 25 are formed. Lower die 11 also includes an inner annular center die ring 41 which has an annular ridge 42 which effectively increases the diameter of the center chute or cylindrical void 43 at annular ridge 42. Cooperatively arranged with the upper die 13 and lower die 11 is a large central cylindrical punch 45 which passes through the disc 15 to cut a center hole of the size defined by the inner ring 41 and punch 45, shown at 47. As punch 45 descends into the lower die region 11 and passes annular ridge 42, the material from disc 15 is remove preferably by compressed air, not shown, or other conventional means.

The upper die 13 includes an outer annular ring 49 which cooperatively forms dependent skirt 25 between annular ring 39 and the inside of outer ring 49. The curved portion 50 of the outer ring 49 facilitates the bending of the disc 15 about the terminal edge 21 and permits the disc to conform to the shape of the die.

Upper die 13 also includes an annular knockout ring 51 which assists in the removal of a complete formed cap at the end of a stroke of the upper and lower dies, using a mechanical arm, not shown, or other conventional means. Angled surface 52 assist in maintaining the shape of the closure during formation of the shoulder 17 and dependent skirt 25.

Figure 5:
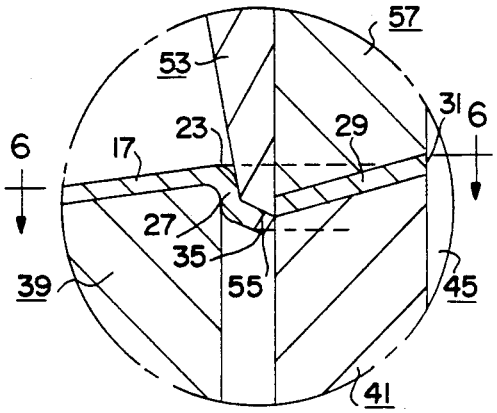
FIG. 5 is a view similar to FIG. 3, taken on the line 5—5 of FIG. 2 and illustrating formation between bridges of a dependent lip.

Turning now to FIG. 3 and FIG. 5, it is seen that the bridges 33 and the annular gaps 35 are formed along with dependant lip 27 by the action of annular stem 53 in upper die 13. This stem 53 includes a cutting edge 55 which folds over the dependent lip 27 at the inner terminal edge 23 of shoulder 17. A central ring 57 is also provided with biasing means or spring 59, in order to firmly locate annular center section 29. Center ring 57 and inner annular center die ring 41 impart a frusto conical shape to annular center section 29 and keep center section 29 firmly place while punch 45 removes the center section, to form the center hole at inner edge 31. Also, during the operation of cutting edge 55 of stems 53, center section 29 is fixedly held in place.

Figure 4:
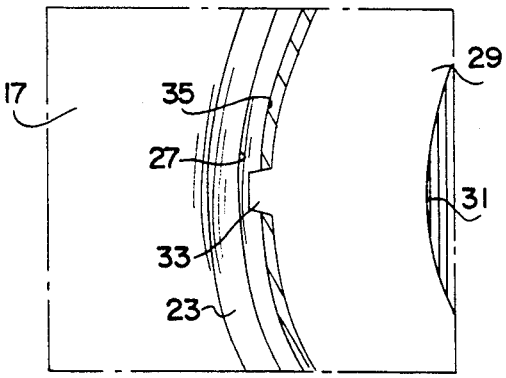
FIGS. 4 and 6 are plane views of FIGS. 3 and 5 respectively.
Figure 6:
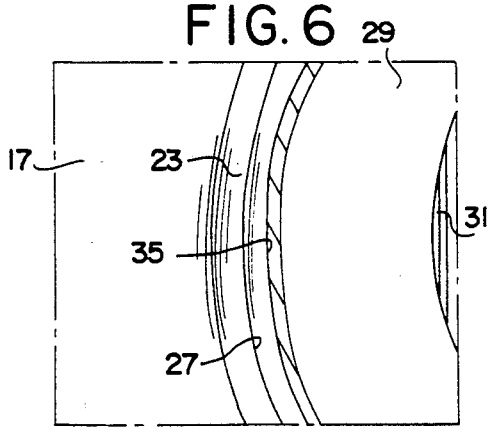

The actual formation of bridges 33 and annular gaps 35 is shown in FIGS. 3 and 5 respectively. As the lower cutting edge 55 of stem 53 pushes the inner terminal edge 23 of shoulder 17 in a downward direction to form the dependent lip 27, slots 61 in stem 53, leave bridges 33 as cutting edge 55 forms grooves 35. As shown in FIG. 4, the bridges 53 are tapered when viewed from the top, extending from a narrow portion on recessed lip 27 to a larger portion on the center section 29.

In FIG. 5, where there is no bridge present, the annular gap 35 represents a clean cut of the disc 15 between the end of the lip 27 and the center section 29. During the cutting stage, when bridges 33 and annular gaps 35 are formed at space 63, the excess material is formed into space 63. Rings 65 provide airflow to and from the ports 67.

Figure 8:
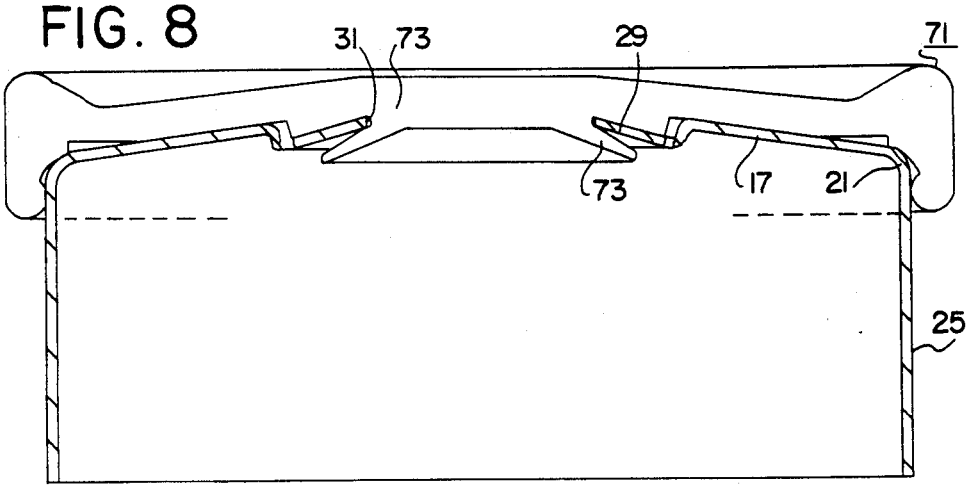
FIG. 8 is a view similar to FIG. 7, showing the addition of a plastic overcap applied to the metal closure of FIG. 7 and prior to mounting on a container.

As has been previously stated, the schematic illustration of dies 11 and 13 are in their final stroke position and the closure of the present invention is in its fully formed state. Turning now to FIG. 8, it can be seen that an overcap 71 has been applied to the closure of this invention. The overcap extends to the outer terminal edges 21 of the shoulder 17. The overcap also contains an inner cylindrical portion 73 which is fitted through the hole 31 at the end of center section 29 and is then turned radially outwardly, as shown in FIG. 8, so that the overcap and under disc 73 surround the annular center section 29 on the top and bottom portions thereof. This means for fastening an overcap to an annular center section of a closure is well known in the art.

Figure 9:
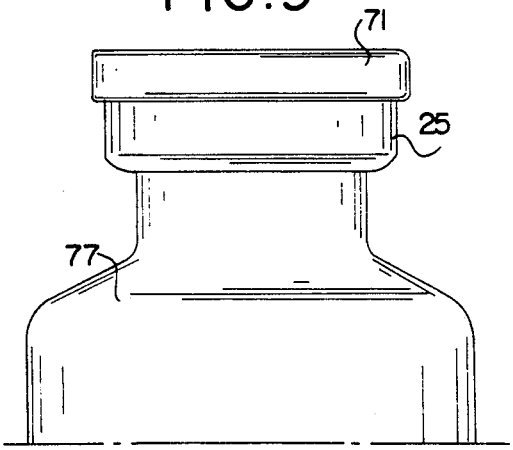
FIGS. 9 is a fragmentary elevational view, showing the assembly of FIG. 8 attached to a container for pharmaceutical goods and the like, where the dependent skirt has been formed onto the finish of the container.

The closure is then fitted to a bottle as shown in FIG. 9. The lower portion of dependent skirt 25 is turned under the finish of the bottle 77, so as to permanently affix the closure to the bottle. In most cases, as has been shown herein, the bottle includes a rubber stopper 79 which rests firmly against shoulder 17 so that the dependent lip 27 is pushed into the elastomeric stopper.

Figure 10:
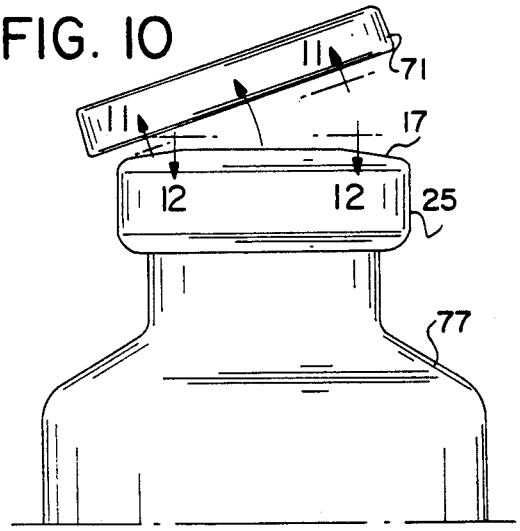
FIG. 10 shows the assembly of FIG. 9 with the plastic flip-off cap portion having been removed.
Figure 12:
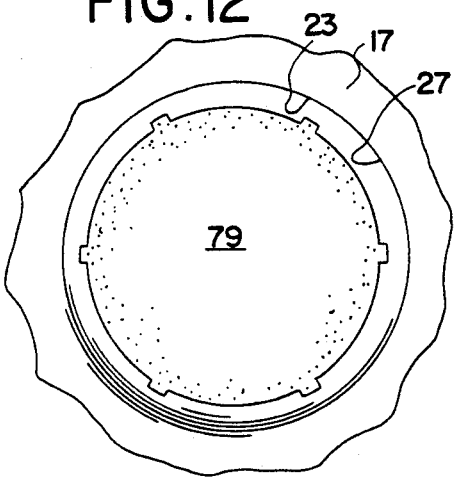
FIG. 12 is an enlarged fragmentary plan view taken along lines 12—12 of FIG. 10, showing the exposed stopper and the lack of exposed sharp projections.

When the overcap 71 is removed, such as in FIG. 10 by pushing the cap 71 off with the thumb, the stopper 79 is exposed, as shown in FIG. 12.

Figure 11:
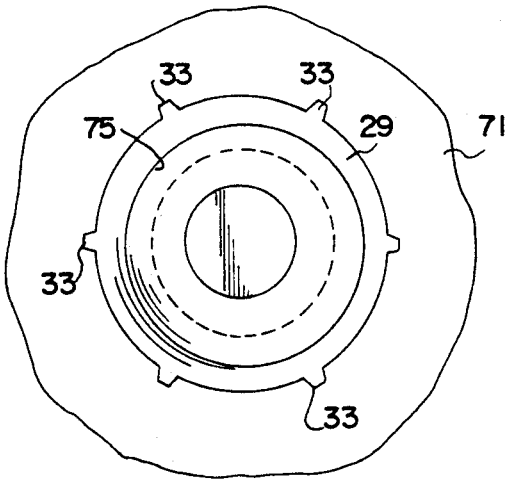
FIG. 11 is an enlarged fragmentary bottom plan view taken on the line 11—11 of FIG. 10 showing the innermost ring of the metallic overcap and the broken sharp ends of the bridges being retained by the removed plastic flip-off cap.

FIG. 11 shows the underside of overcap 71 after the frangible bridges 33 have been broken by thumb pressure or the like. The bridges 33 remain with the center section 29 and are discarded. As shown in FIG. 12, the stopper 79 is free from sharp protuberances as the recessed lip 27 is directed into the stopper 79 and the bridges 33 have all been removed. The fracture line of the bridge 33 which was separated from the lip 27 is embedded in the stopper 79 and is not exposed.

Thus, it can be seen that a safe closure has been provided where the advantages of a frangible bridge design permitting easy removal of an overcap are maintained without the inherent drawbacks of prior art designs. The usable product, after the overcap has been removed, is safe and without prior art problems.

While particular embodiments of the present invention have been illustrated and described herein, it is not intended to limit the invention and changes and modifications may be made therein without departing from the scope of the following claims.

What is claimed is:

1. A closure for holding a stopper in place in a container, comprising:

a cap of generally cup-like form having an annular top with inner and outer circumferentially extending peripheral edges;

a skirt depending from the outer peripheral edge of said top extending in a downward direction generally parallel to the axis of said cap;

a recessed lip depending from the inner peripheral edge of said top extending generally in a downward axial direction; and a removable disc portion connected by a plurality of circumferentially spaced bridges to the inner peripheral edge of said top, said bridges tapering from a first width at the juncture with said inner peripheral edge to a smaller width at a second juncture of said downwardly depending axial lip whereby the fracture point of said bridges upon removal of said disc is controlled at said second juncture without affecting upward displacement of said downwardly depending recessed lip so that it faces downwardly around its entire periphery even after removal of said disc portion.

2. A closure as claimed in claim 1 wherein said disc portion is a frusto conical configuration and wherein the tapered sides of said bridges have slightly rounded downwardly turned edges to add rigidity to said bridges.

3. A closure as claimed in claim 1 including an overcap made of plastic connected to the disc portion having at least a portion extending beyond the outer peripheral edge of said top to serve as a lever for removing the disc portion.

4. A closure as claimed in claim 3 wherein the closure is made of aluminum and the overcap is made of plastic.

5. A closure as claimed in claim 1 wherein the juncture of the bridges to the depending lip lies in a plane below the top of said cap.

* * * * *

UNITED STATES PATENT AND TRADEMARK OFFICE

CERTIFICATE OF CORRECTION

PATENT NO. : 5,152,413

DATED : October 6, 1992

INVENTOR(S) : William A. Conard

It is certified that error appears in the above-indentified patent and that said Letters Patent is hereby corrected as shown below:

On the title page, under item [19] and [75], change the inventor's name from "Conrad" to --Conard--.

Column 3, line 62; delete the letter "t" and insert the word --to--.

Signed and Sealed this

Fourteenth Day of December, 1993

*Attest:*

BRUCE LEHMAN

*Attesting Officer*

*Commissioner of Patents and Trademarks*